US011639774B1

(12) United States Patent
Wang

(10) Patent No.: US 11,639,774 B1
(45) Date of Patent: May 2, 2023

(54) SELECTABLE ADJUSTABLE CONTROL FOR CHANGING COLOR TEMPERATURE AND BRIGHTNESS OF AN LED LAMP

(71) Applicant: Tiejun Wang, Lin'an (CN)

(72) Inventor: Tiejun Wang, Lin'an (CN)

( * ) Notice: Subject to any disclaimer, the term of this patent is extended or adjusted under 35 U.S.C. 154(b) by 0 days.

(21) Appl. No.: 17/532,080

(22) Filed: Nov. 22, 2021

(51) Int. Cl.

| | |
|---|---|
| ***F21K 9/232*** | (2016.01) |
| ***F21V 23/00*** | (2015.01) |
| ***F21K 9/238*** | (2016.01) |
| ***F21Y 113/10*** | (2016.01) |
| ***F21Y 115/10*** | (2016.01) |

(52) U.S. Cl.
CPC ..... *F21K 9/232* (2016.08); *F21K 9/238* (2016.08); *F21V 23/003* (2013.01); *F21Y 2113/10* (2016.08); *F21Y 2115/10* (2016.08)

(58) Field of Classification Search
CPC ..... F21K 9/232; F21K 9/238; F21V 23/003
USPC ..... 362/363
See application file for complete search history.

(56) References Cited

U.S. PATENT DOCUMENTS

| | | | | |
|---|---|---|---|---|
| 2003/0133292 | A1* | 7/2003 | Mueller | H05B 45/10 362/231 |
| 2009/0141474 | A1* | 6/2009 | Kolodin | F21V 3/04 362/84 |
| 2011/0096552 | A1* | 4/2011 | Falicoff | F21K 9/64 362/297 |
| 2012/0287601 | A1* | 11/2012 | Pickard | F21V 3/06 362/231 |
| 2014/0265923 | A1* | 9/2014 | Le Toquin | F21K 9/232 315/297 |
| 2015/0036341 | A1* | 2/2015 | Ge | F21V 3/02 362/240 |
| 2015/0091451 | A1* | 4/2015 | Williams | H05B 45/10 315/160 |
| 2018/0020522 | A1* | 1/2018 | Rogers, III | F21K 9/65 |
| 2019/0215927 | A1* | 7/2019 | Sooch | H05B 45/20 |

* cited by examiner

*Primary Examiner* — Bryon T Gyllstrom
(74) *Attorney, Agent, or Firm* — Daniel M. Cohn; Howard M. Cohn

(57) ABSTRACT

Disclosed embodiments provide techniques and devices for changing the color temperature and/or brightness of an LED lamp utilizing a selectable control device. The selectable control device may include one or more buttons, sliders, and/or rotary knobs. The buttons, sliders, and/or rotary knobs may be coupled to resistors, including variable resistors (potentiometers), that utilize resistance shunting. In embodiments, the shunt resistance varies under different dialing conditions (configuration of the selectable control device), so as to obtain different current ratios and achieve the purpose of mixing different color temperatures.

20 Claims, 12 Drawing Sheets

SELECTABLE ADJUSTABLE CONTROL FOR CHANGING COLOR TEMPERATURE AND BRIGHTNESS OF AN LED LAMP

FIELD

The present invention relates generally to lighting control, and more particularly to a selectable adjustable control for changing color temperature and brightness of an LED lamp.

BACKGROUND

Color temperature defines the color appearance of a white light. CCT is defined in degrees Kelvin; a warm light is around 2700K, moving to neutral white at around 4000K, and to cool white, at 5000K or more. Since it is a single number, CCT is simpler to communicate than chromaticity or SPD, leading the lighting industry to accept CCT as a shorthand means of reporting the color appearance of "white" light emitted from electric light sources.

Phase-cut dimmers are the most common dimming control and are often referred to as TRIAC dimmers. A phase-cut light dimmer is used to adjust power that is supplied to a lamp in order to adjust the brightness (amount of light) emitted by the lamp. Phase-cut dimmers modify an alternating current (AC) signal that is input to a lighting device by "cutting" or removing some portion of the sinusoidal waveform phase, which reduces the root-mean-square (RMS) voltage of the waveform. An incandescent lamp's illumination is based on thermal radiation. Therefore, both output brightness and correlated color temperature (CCT) of an incandescent lamp's emitted light is a positive function of the lamp's input power, in that both brightness and CCT increase with increasing input power and decreases with decreasing power.

Light Emitting Diode (LED) technology is being used in more and more lighting applications. LED technology is highly energy efficient, and has the potential to fundamentally change the future of lighting. Typical LED-based products use at least 75% less energy, and last 25 times longer, than incandescent lighting. Since, lighting plays an important role in the design and usability of interior spaces, it is desirable to have improvements in LED lighting control.

SUMMARY

In one embodiment, there is provided an apparatus comprising: an LED (light emitting diode) driver, the driver configured to provide power to: a first LED that is configured to emit a first white light of a first correlated color temperature (CCT); a second LED that is configured to emit a second white light of a second CCT that is lower than the first CCT, for the first white light to mix with the second white light to yield a combined white light having a combined-light CCT with a combined-light brightness; receive a user-adjustable DC input voltage Vin from a selectable control device, wherein the selectable control device comprises a plurality of CCT selection values; and distribute supply power to the first LED and second LED.

In another embodiment, an apparatus comprising: a microcontroller; an LED (light emitting diode) driver; a controller configured to provide power to: a first LED that is configured to emit a first white light of a first correlated color temperature (CCT); a second LED that is configured to emit a second white light of a second CCT that is lower than the first CCT, for the first white light to mix with the second white light to yield a combined white light having a combined-light CCT with a combined-light brightness; wherein the microcontroller is configured to receive a user-adjustable DC input voltage Vin from a selectable control device, wherein the selectable control device comprises a plurality of CCT selection values; and wherein the driver is configured to distribute supply power to the first and second light-emitting devices according to a power-distribution scheme based on a configuration of the selectable control device.

In yet another embodiment, there is provided a lightbulb comprising: a first LED (light emitting diode); a second LED; an LED driver, the driver configured to: provide power to: the first LED, wherein the first LED is configured to emit a first white light of a first correlated color temperature (CCT); and the second LED, wherein the second LED is configured to emit a second white light of a second CCT that is lower than the first CCT, enabling the first white light to mix with the second white light to yield a combined white light having a combined-light CCT with a combined-light brightness; receive a user-adjustable DC input voltage Vin from a selectable control device, wherein the selectable control device comprises a plurality of CCT selection values; and distribute supply power to the first and second light-emitting devices according to a power-distribution scheme based on a configuration of the selectable control device; and a base configured and disposed to mechanically and electrically engage with a light socket.

BRIEF DESCRIPTION OF THE DRAWINGS

The structure, operation, and advantages of the present invention will become further apparent upon consideration of the following description taken in conjunction with the accompanying figures (FIGs). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
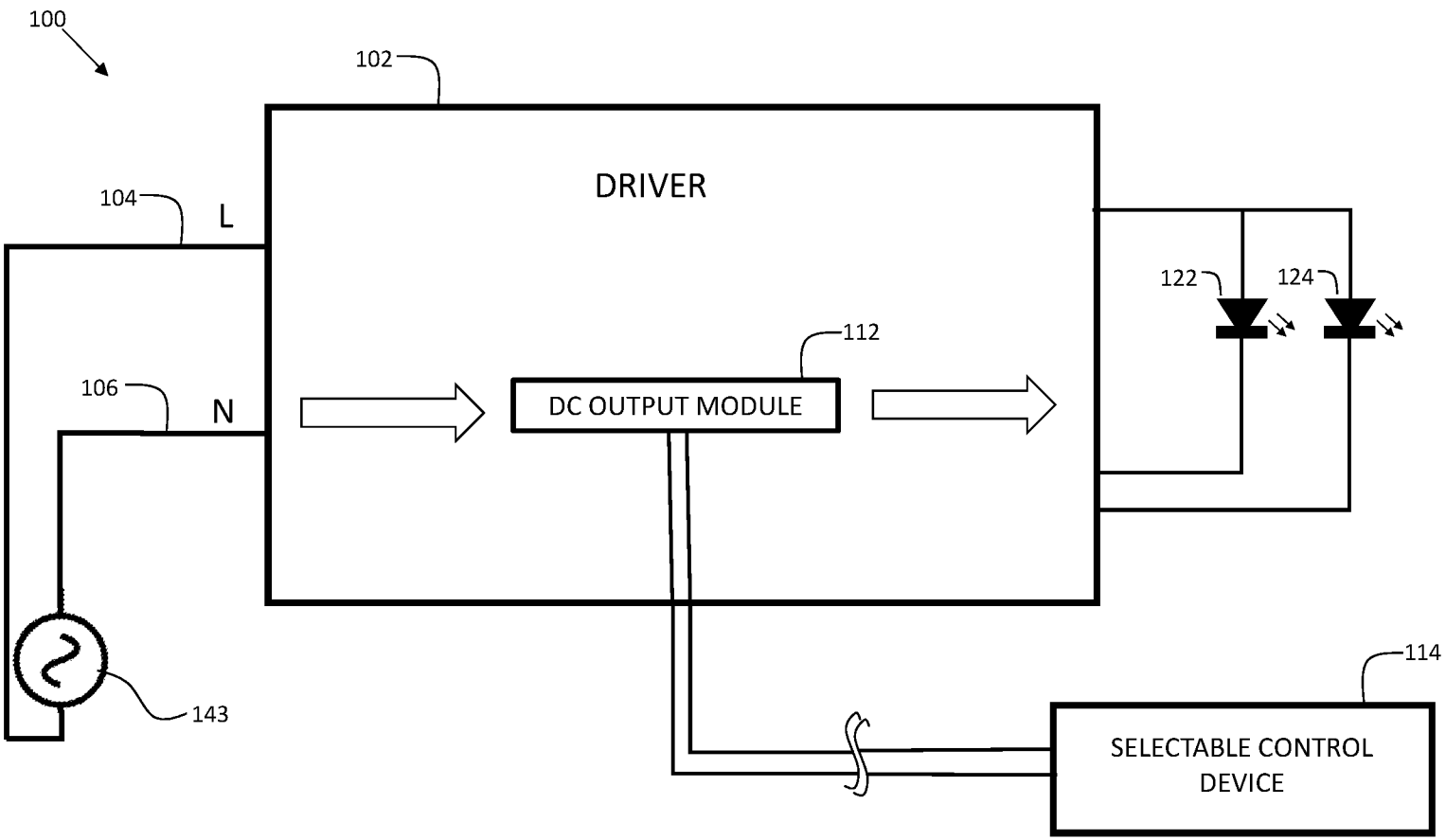

Often, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1 is a diagram of an apparatus with a selectable control device in accordance with embodiments of the present invention.

Figure 2:
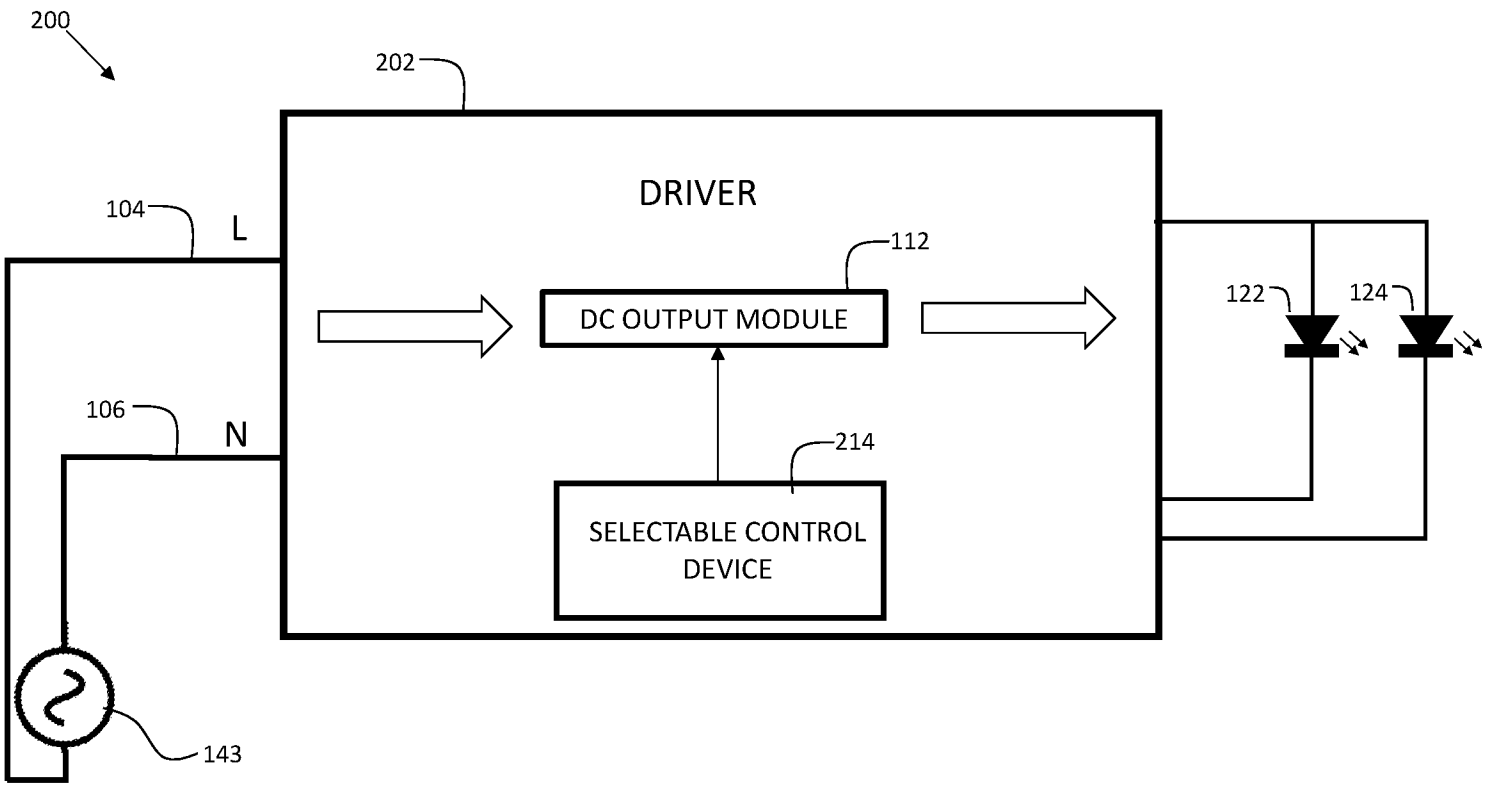

FIG. 2 is a diagram of an apparatus in accordance with additional embodiments of the present invention with an integrated selectable control device.

Figure 3:
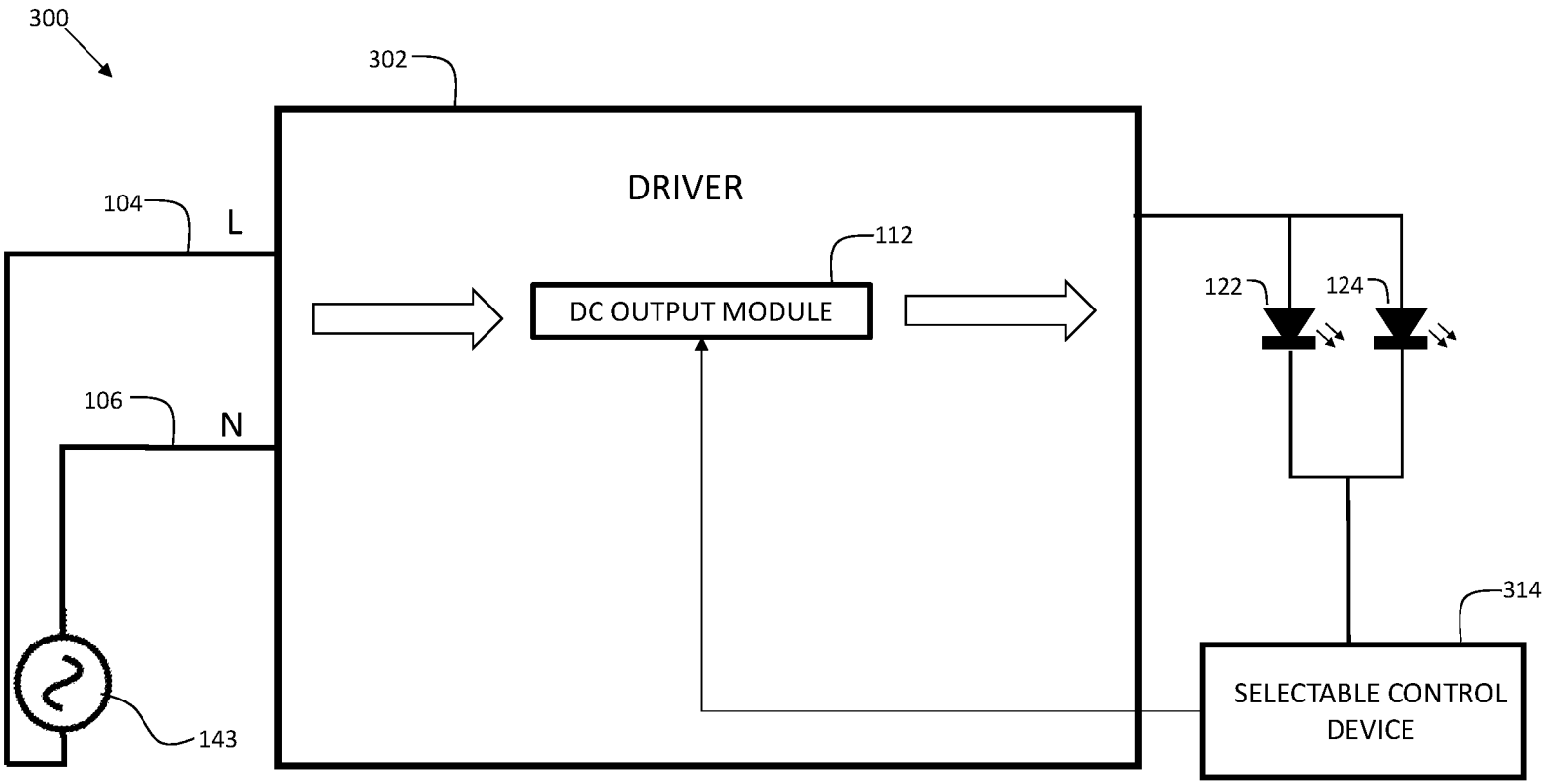

FIG. 3 is a diagram of an apparatus with a selectable control device in series configuration in accordance with additional embodiments of the present invention.

Figure 4:
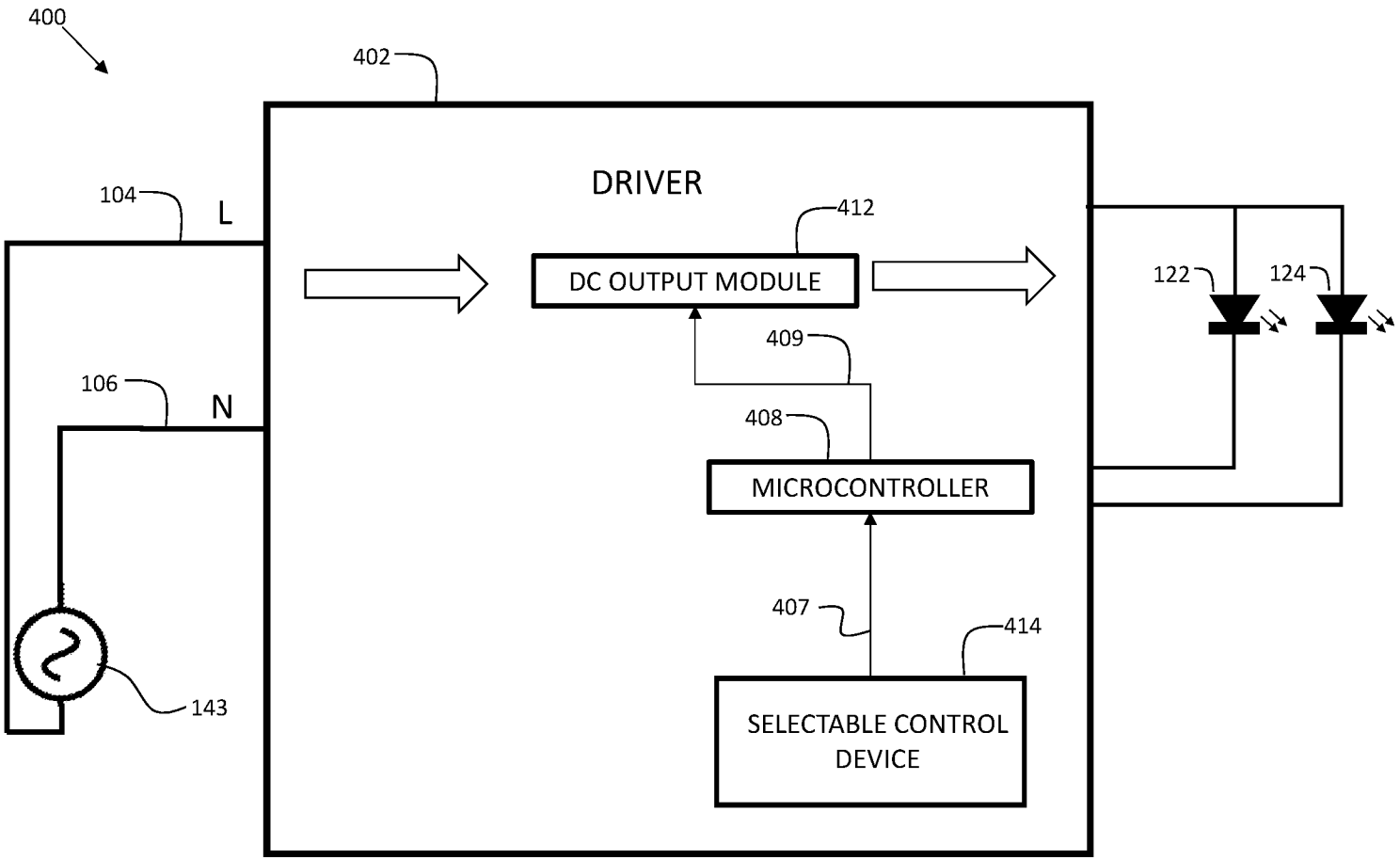

FIG. 4 is a diagram of an apparatus in accordance with a microcontroller unit and integrated selectable control device in accordance with additional embodiments of the present invention.

Figure 5:
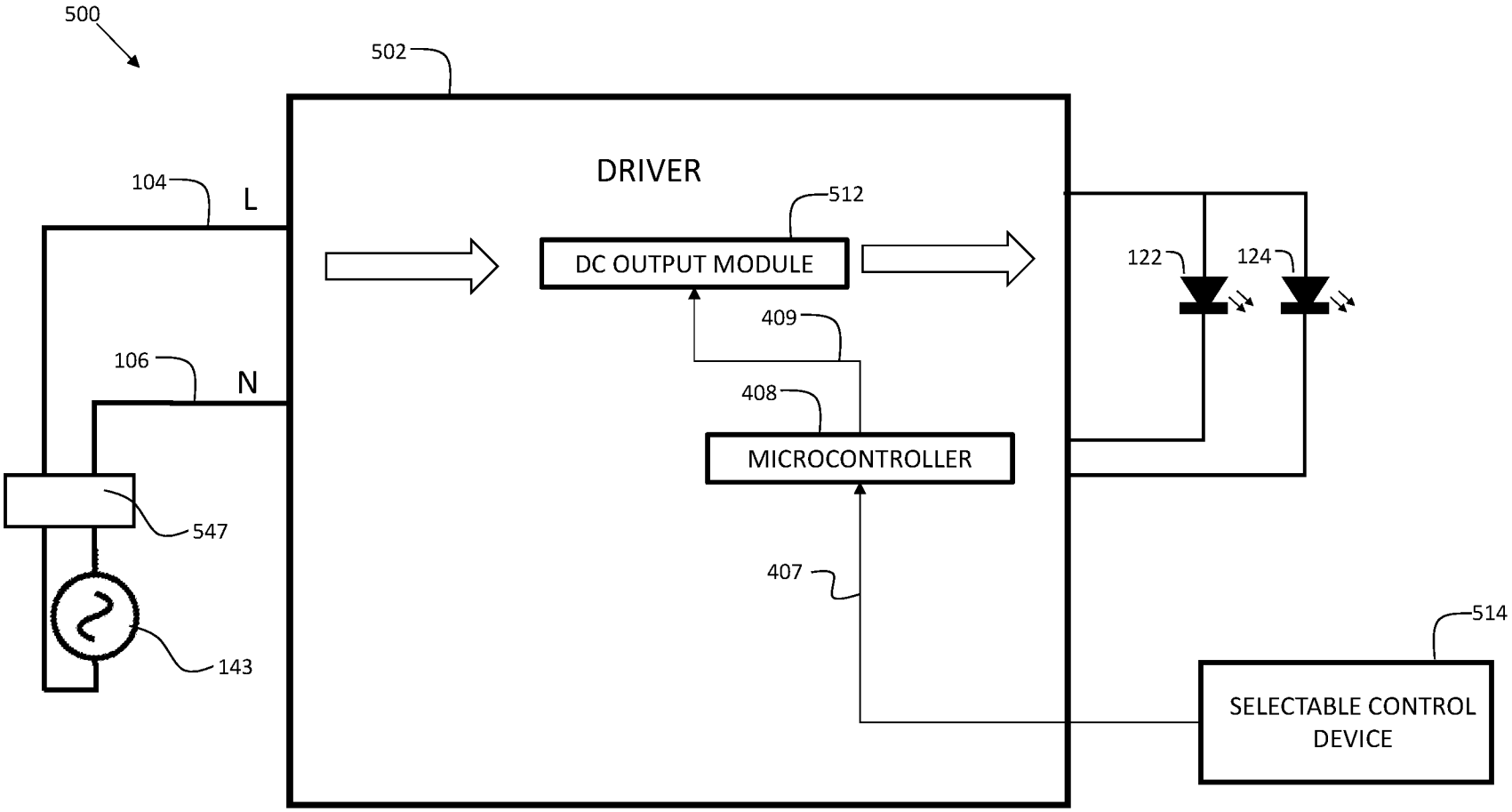

FIG. 5 is a diagram of an apparatus in accordance with a microcontroller unit and external selectable control device in accordance with additional embodiments of the present invention.

Figure 6:
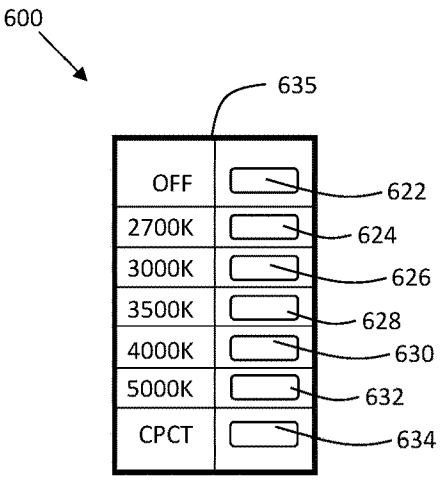

FIG. 6 shows a user interface of a selectable control device in accordance with embodiments of the present invention.

Figure 7:
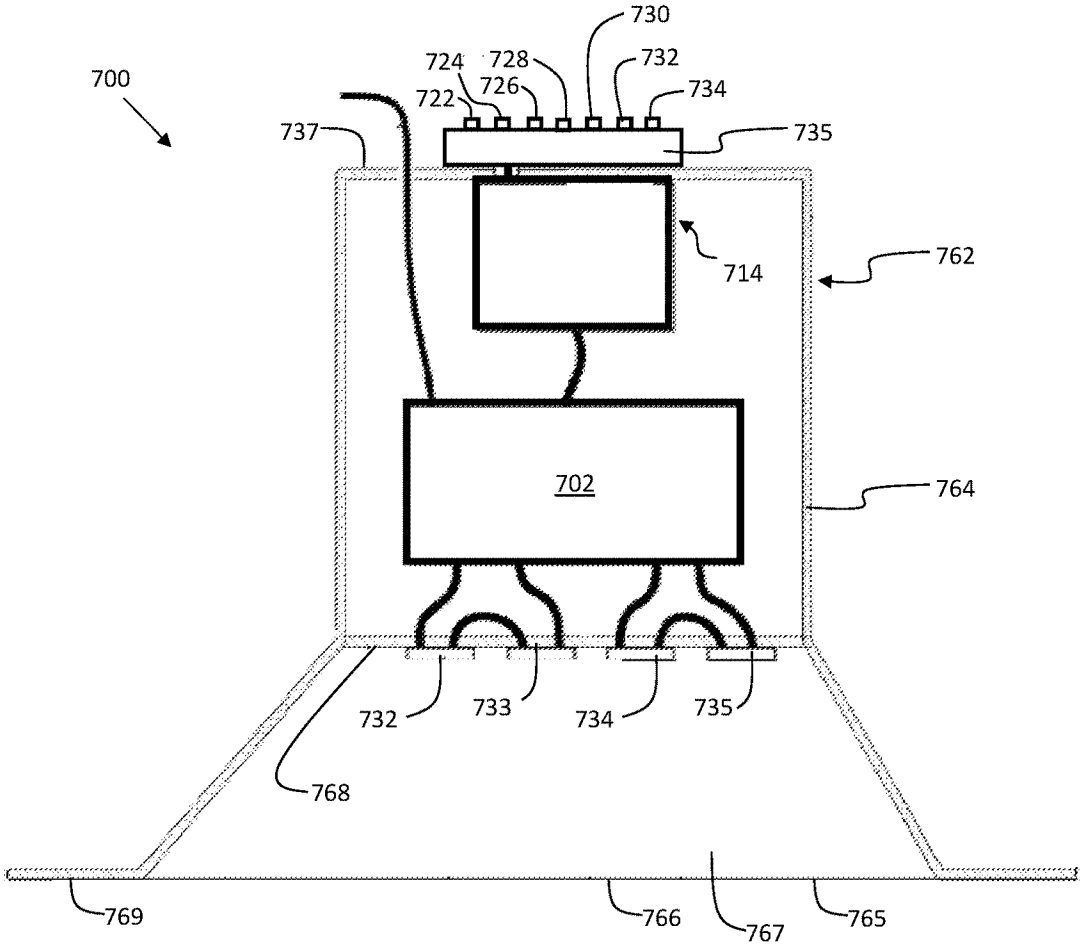

FIG. 7 is a side cutaway view of an indoor downlight device utilizing embodiments of the present invention.

Figure 8:
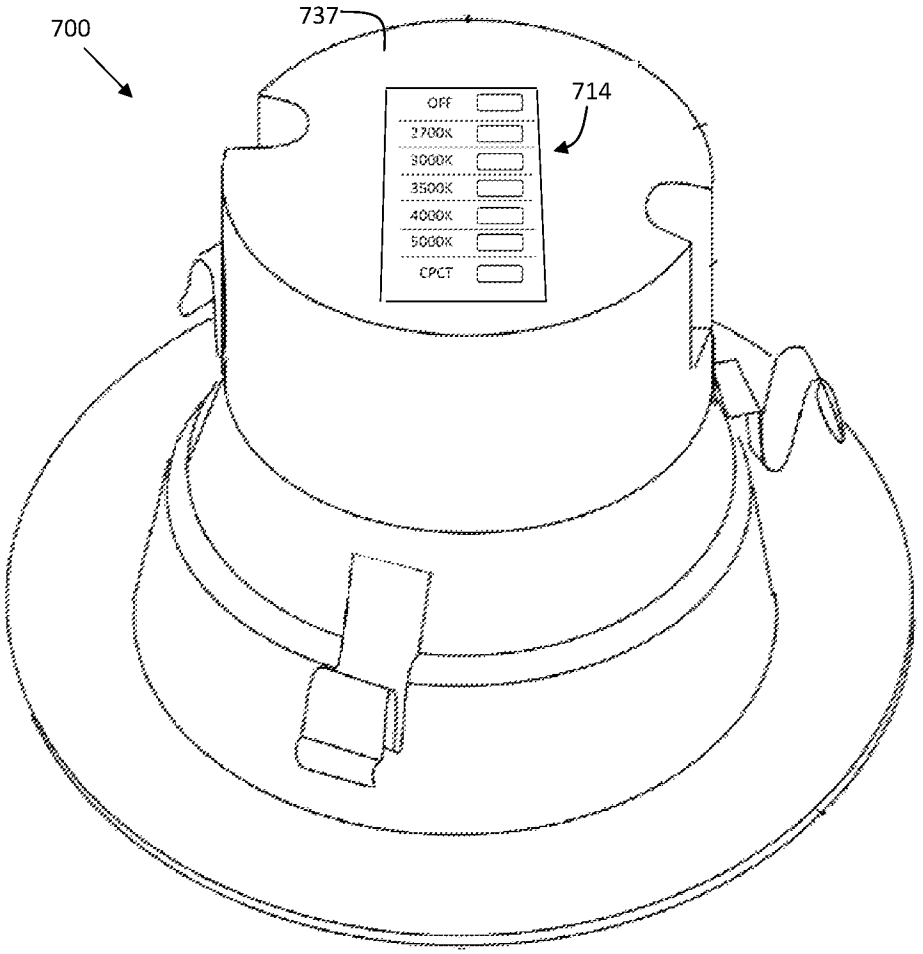

FIG. 8 is a perspective view of the indoor downlight device of FIG. 7.

Figure 9:
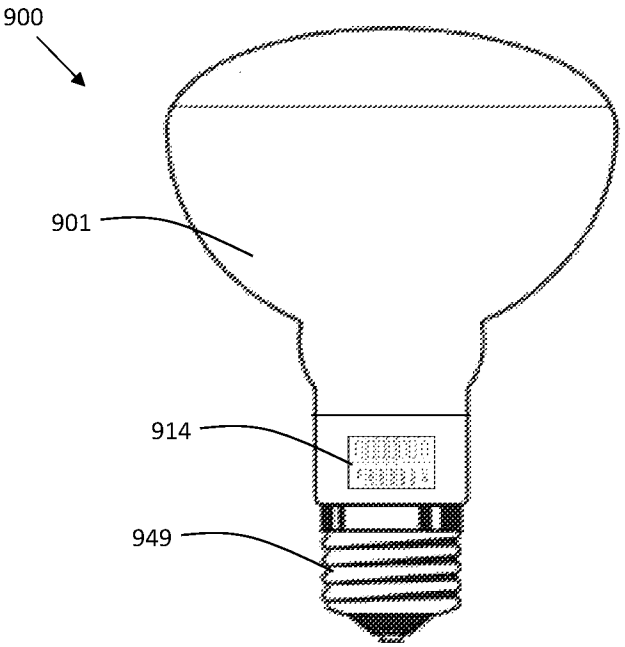

FIG. 9 is a side view of an embodiment utilizing a BR-type lightbulb.

Figure 10:
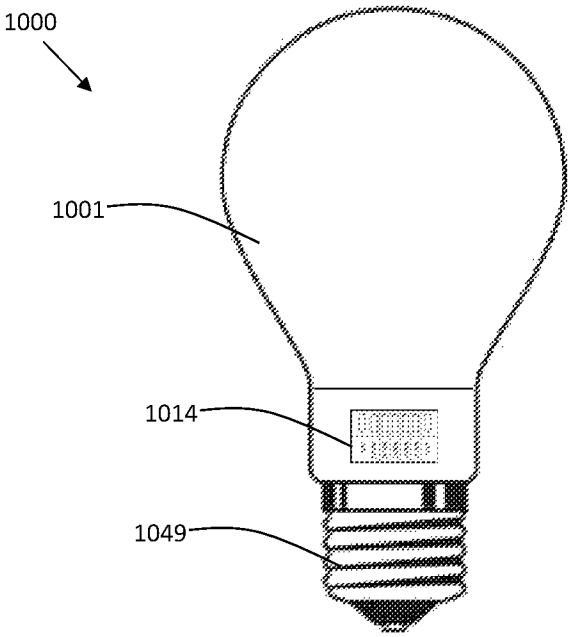

FIG. 10 is a side view of an embodiment utilizing an A-type lightbulb.

Figure 11:
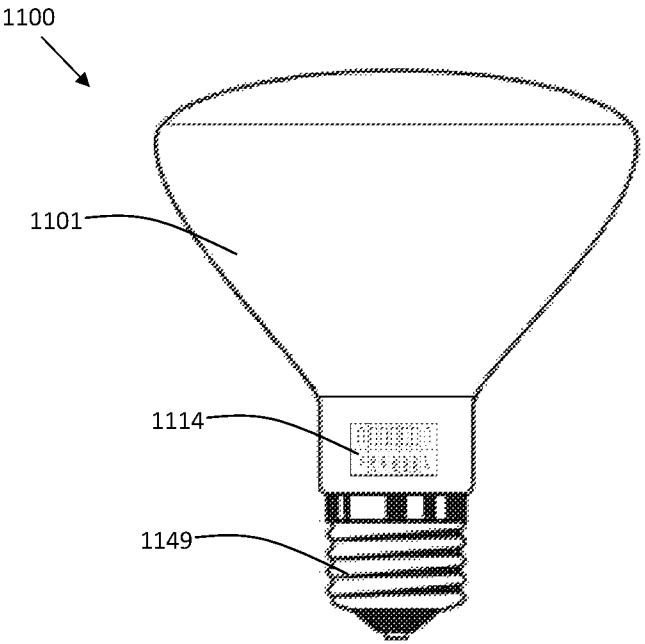

FIG. 11 is a side view of an embodiment utilizing a PAR-type lightbulb.

FIGS. 12-15 are example voltage traces of input supply power that the selectable control device might output to a controller.

Figure 16:
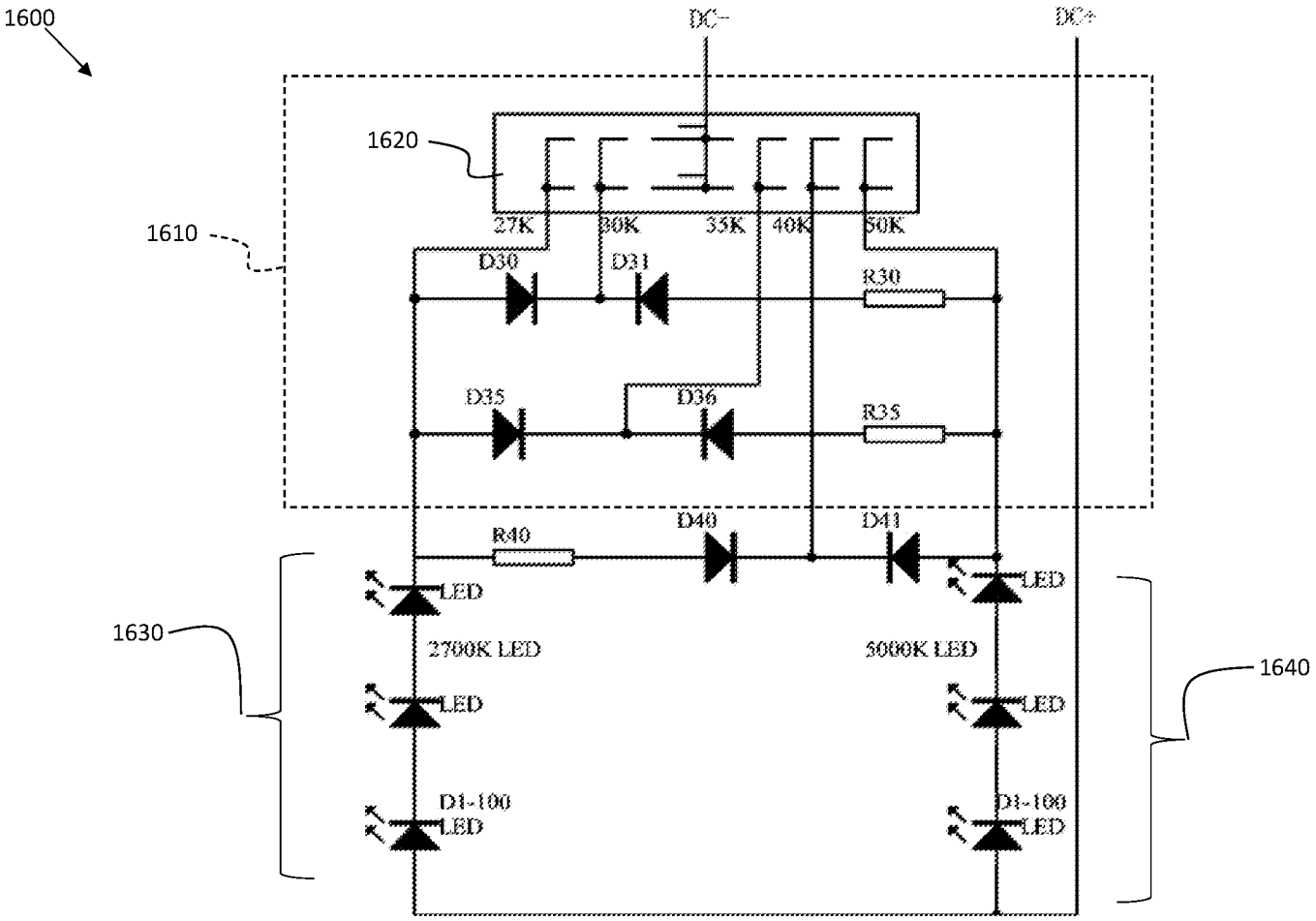

FIG. 16 shows a schematic representation of a selectable control device in accordance with disclosed embodiments.

DETAILED DESCRIPTION

Disclosed embodiments provide techniques and devices for changing the color temperature and/or brightness of an LED lamp utilizing a selectable control device. The selectable control device may include one or more buttons, sliders, and/or rotary knobs. The buttons, sliders, and/or rotary knobs may be coupled to resistors, including variable resistors (potentiometers), that utilize resistance shunting. In embodiments, the shunt resistance varies under different dialing conditions (configuration of the selectable control device), so as to obtain different current ratios and achieve the purpose of mixing different color temperatures.

Embodiments may further include a constant power/color temperature (CPCT) mode. This may be achieved by detecting the phase angle signal of TRIAC dimming, corresponding to different phase angles, different operating modes are possible. In a first mode, the power is constant while the color temperature changes as a result of configuration of the selectable control device. In a second mode, both the power and the color temperature change as a result of configuration of the selectable control device. In a third mode, the power changes and the color temperature remains constant as a result of the configuration of the selectable control device. In some embodiments, the selectable control device 114 may further include an integrated dimmer with a slider control, rotary knob control, or other suitable adjustment mechanism. Other embodiments may utilize an external dimmer.

FIG. 1 shows an example circuit 100 in accordance with embodiments of the present invention configured for selectable control. Circuit 100 includes LED driver 102, which includes a DC (direct current) output module 112. The driver 102 includes AC/DC converters, voltage convertors, rectifiers, and/or other components to produce a low-voltage signal for powering light-emitting devices 122, and 124. In embodiments, light-emitting devices 122 and 124 are LEDs. In embodiments, light-emitting device 122 has a first CCT value and light-emitting device 124 has a second CCT value. By combining light from light-emitting device 122 and light-emitting device 124, a combined white light with various CCT values can be produced.

The LED driver 102 comprises an input 104 and an input 106. Input 104 may be an L (line, or hot) signal, and input 106 may be a neutral (N) signal, as provided by an AC power source 143.

A selectable control device 114 is configured and disposed to control the DC output module 112 of the driver 102. The selectable control device 114 may include one or more switches, sliders, buttons, knobs, and/or dials for controlling output to the light-emitting devices 122 and 124.

In embodiments, the selectable control device is used to select the mode and can select a specific color temperature such as 5000K, 4000K, and/or 3000K. Embodiments can also include a constant power/color temperature (CPCT) mode, and cooperate with a dimmer to achieve the function of not only constant power color temperature, but also light adjustment. In embodiments, the selectable control device is installed on the lamp (lightbulb) body, which can facilitate the realization of dialing (configuration of the selectable control device). In embodiments, in a first range, power and CCT are constant, in a second range, power is constant and CCT varies, in a third range, both power and CCT vary, and in a fourth range, the power varies and the CCT is constant. In embodiments, the selectable control device is a rotary knob having a range from zero to 180 degrees. In some embodiments, the rotary knob is configured such that between zero to 20 degrees, power and CCT are constant. In a range from 20 degrees to 40 degrees, power is constant, and CCT varies from 5000K to 3000K. In a range from 40 degrees to 60 degrees, power and CCT vary, and in a range from 60 degrees to 180 degrees, power varies, and CCT is constant at 2000K. Other ranges and CCT values are possible in disclosed embodiments.

FIG. 2 shows an example circuit 200 in accordance with embodiments of the present invention configured for a selectable control using an integrated selectable control device. Circuit 200 includes LED driver 202, which includes a DC (direct current) output module 112 similar to as described for FIG. 1. The driver 202 includes AC/DC converters, voltage convertors, rectifiers, and/or other components to produce a low-voltage signal for powering light-emitting devices 122, and 124. In embodiments, light-emitting devices 122 and 124 are LEDs. In embodiments, light-emitting device 122 has a first CCT value and light-emitting device 124 has a second CCT value. By combining light from light-emitting device 122 and light-emitting device 124, a combined white light with various CCT values can be produced.

The LED driver 202 comprises an input 104 and an input 106. Input 104 may be an L (line, or hot) signal, and input 106 may be a neutral (N) signal, as provided by an AC power source 143. A selectable control device 214 is configured and disposed to control the DC output module 112 of the driver 202. The selectable control device 214 may include one or more switches, sliders, buttons, knobs, and/or dials for controlling output to the light-emitting devices 122 and 124.

In embodiments, the selectable control device is used to select the mode and can select a specific color temperature such as 5000K, 4000K, and/or 3000K. Embodiments can also include a constant power/color temperature (CPCT) mode, and cooperate with a dimmer to achieve the function of not only constant power color temperature, but also light adjustment. In embodiments, the selectable control device is installed on the lamp (lightbulb) body, which can facilitate the realization of dialing (configuration of the selectable control device). The lightbulb body can include an A-type form factor, BR-type form factor, PAR-type form factor, or other suitable form factor. The lamp body can include a downlight device, or other suitable lighting device that includes an enclosure, and connection terminals such as a screw terminal (Edison screw), prongs, bayonet cap base, or other interface to connect to a lighting system. In embodiments, the screw terminal of the base is configured and disposed to mechanically and electrically engage with a light socket.

FIG. 3 shows an example circuit 300 in accordance with embodiments of the present invention configured for a selectable control device in series configuration in accordance with additional embodiments of the present invention. Circuit 300 includes LED driver 302, which includes a DC (direct current) output module 112 similar to as described for FIG. 1. The driver 302 includes AC/DC converters, voltage convertors, rectifiers, and/or other components to produce a low-voltage signal for powering light-emitting devices 122 and 124

The LED driver 302 comprises an input 104 and an input 106. Input 104 may be an L (line, or hot) signal, and input 106 may be a neutral (N) signal, as provided by an AC power source 143.

A selectable control device 314 is configured and disposed to control the DC output module 112 of the driver 302. The selectable control device 314 may include one or more switches, sliders, buttons, knobs, and/or dials for controlling output to the light-emitting devices 122 and 124. In this configuration, the selectable control device 314 is configured in electrical series with the light-emitting devices 122 and 124. In embodiments, selectable control device 314 may be similar to selectable control device 114 of FIG. 1, with possible variations in connection terminals to support a series connection to the light-emitting devices. In embodiments, the selectable control device is configured and disposed to be in series with the first LED and second LED.

FIG. 4 shows an example circuit 400 in accordance with embodiments of the present invention including a microcontroller unit (MCU) 408 and integrated selectable control device 414 in accordance with additional embodiments of the present invention. Circuit 400 includes LED driver 402, which includes a DC (direct current) output module 412. DC output module 412 may be similar to DC output module 112 described for FIG. 1, but may be further configured to receive a PWM input from microcontroller 408 to determine output voltages/currents provided to the light-emitting devices 122 and 124. The driver 402 includes AC/DC converters, voltage convertors, rectifiers, and/or other components to produce a low-voltage signal for powering light-emitting devices 122, and 124. In embodiments, light-emitting devices 122 and 124 are LEDs. In embodiments, light-emitting device 122 has a first CCT value and light-emitting device 124 has a second CCT value. By combining light from light-emitting device 122 and light-emitting device 124, a combined white light with various CCT values can be produced. In embodiments, the microcontroller 408 is configured such that the signal provided to the driver comprises a pulse-width modulated (PWM) signal.

The selectable control device 414 is configured and disposed to control the DC output module 412 of the driver 402. The selectable control device 414 may include one or more switches, sliders, buttons, knobs, and/or dials for controlling output to the light-emitting devices 122 and 124. In some embodiments, the selectable control device can be a wireless receiving module. In this configuration, the selectable control device 314 is configured to control a signal that is configured as an input to microcontroller 408. The microcontroller includes a processing unit that executes instructions stored in a built-in non-transitory computer-readable medium. The instructions, when executed by the microcontroller, cause the microcontroller to adjust a PWM output 409 in response to a voltage change in input 407, caused by resistance changes that are due to configuration of the selectable control device 414. In the embodiment shown in FIG. 4, the selectable control device 414 is integrated into the LED driver 402.

FIG. 5 shows an example circuit 500 in accordance with embodiments of the present invention including a microcontroller unit (MCU) 408 and external selectable control device 514 in accordance with additional embodiments of the present invention.

Circuit 500 includes LED driver 502, which includes a DC (direct current) output module 512. DC output module 512 may be similar to DC output module 112 described for FIG. 1, but may be further configured to receive a PWM input from microcontroller 408 to determine output voltages/currents provided to the light-emitting devices 122 and 124. The driver 502 includes AC/DC converters, voltage convertors, rectifiers, and/or other components to produce a low-voltage signal for powering light-emitting devices 122, and 124. In embodiments, light-emitting devices 122 and 124 are LEDs. In embodiments, light-emitting device 122 has a first CCT value and light-emitting device 124 has a second CCT value. By combining light from light-emitting device 122 and light-emitting device 124, a combined white light with various CCT values can be produced. In embodiments, the microcontroller 408 is configured such that the signal provided to the driver comprises a pulse-width modulated (PWM) signal.

The selectable control device 514 is configured and disposed to control the DC output module 512 of the driver 502. The selectable control device 514 may include one or more switches, sliders, buttons, knobs, and/or dials for controlling output to the light-emitting devices 122 and 124. In this configuration, the selectable control device 314 is configured to control a signal that is configured as an input to microcontroller 408. The microcontroller includes a processing unit that executes instructions stored in a built-in non-transitory computer-readable medium. The instructions, when executed by the microcontroller, cause the microcontroller to adjust a PWM output 409 in response to a voltage change in input 407, caused by resistance changes that are due to configuration of the selectable control device 514. In the embodiment shown in FIG. 5, the selectable control device 514 is external to the LED driver 502.

The LED driver 102 comprises an input 104 and an input 106. Input 104 may be an L (line, or hot) signal, and input 106 may be a neutral (N) signal, as provided by an AC power source 143. In this embodiment, an external dimmer 547 is shown. The external dimmer 547 may be mounted on a wall, or other suitable location for controlling the brightness of the light-emitting devices 122, and 124. The other embodiments shown in FIGS. 1-4 may also utilize an external dimmer.

FIG. 6 shows a user interface of a selectable control device 600 in accordance with embodiments of the present invention. In embodiments, the selectable control device 600 comprises a plurality of buttons disposed within a housing 635, the buttons indicated as 622-634. Each button may configure a different resistance, resulting in a different voltage input to an LED driver and/or microcontroller unit (MCU). Button 622 may configure an infinite (or sufficiently high) resistance, corresponding to an "off" configuration. Button 624 may correspond to a first resistance, which corresponds to a CCT value of 2700K. Button 626 may correspond to a second resistance, which corresponds to a CCT value of 3000K. Button 628 may correspond to a third resistance, which corresponds to a CCT value of 3500K. Button 630 may correspond to a fourth resistance, which corresponds to a CCT value of 4000K. Button 632 may correspond to a fifth resistance, which corresponds to a CCT value of 5000K. Other resistance values may be used to allow selection of other CCT values. Additionally, one or more sliders, knobs, dials, switches, buttons, or other suitable controls may be included to allow selection of one or more resistance values that correspond to a CCT value for a combined white light from multiple light-emitting devices. Button 634 may correspond to a sixth resistance, which corresponds to a CPCT mode of operation.

In the CPCT mode of operation, the selectable control device 600 may operate with a circuit that includes a TRIAC. The TRIAC inputs electrical supply power (electrical current) in the form of an AC (alternating current) input supply voltage, which can include a mains (wall power) 120V 60 Hz electrical supply.

The TRIAC inputs an alternating electrical current at its input terminal. When the TRIAC is triggered by a positive or negative trigger voltage applied to the TRIAC's gate, the TRIAC starts to conduct the input current to the TRIAC's output. The TRIAC continues to conduct even after the trigger voltage ceases. The conduction ceases when the input current drops below a holding current level which can be substantially near zero current. Thus, within a half-cycle in either direction of current, the TRIAC is in a conducting state from the time it receives the gate trigger until the end of the half-cycle. Within a half-cycle, the earlier the controller applies the trigger, the greater the conduction-time during that half-cycle, and therefore the greater the current and power applied to the lamp, and therefore the greater the lamp's brightness. The TRIAC dimmer includes a TRIAC controller that controls the power applied to the lamp by controlling the time at which the trigger is applied.

In embodiments, the selectable control device includes five CCT settings. In particular embodiments, the five CCT settings include: a 2700K setting; a 3000K setting; a 3500K setting; a 4000K setting; and a 5000K setting. In embodiments, the selectable control device may further include a constant power color temperature (CPCT) setting.

FIG. 7 is a side cutaway view of an indoor downlight device 700 utilizing embodiments of the present invention. The device 700 has a lamp housing 762. The lamp housing 762 has a top defined by a horizontal flat top surface 737. The housing 762 has a side surface 764 that includes a substantially-cylindrical upper section and a frustoconical (flared) lower section. The lamp housing 762 has a bottom 765 with a round bottom opening 766. The bottom opening 766 opens to a light cavity 767 in the housing 762. In the light cavity 767, light-emitting devices 732-735 are mounted to an internal surface 768 in the housing 762. The light-emitting devices 732-735 emit light that exits the cavity 767 through the bottom opening 766 and is directed downward. The bottom opening 766 is surrounded and bounded by an annular flange 769 that extends radially outward from the bottom opening 6. The top surface 737, the side surface 764, the bottom opening 766, and the flange 769 are components of the housing 762.

The device 700 in this example includes selectable control device 714 for adjusting characteristics (e.g., brightness and CCT) of combined white light emitted by the downlight device 700. The selectable control device 714 may be similar to the selectable control device 600 shown in FIG. 6. The selectable control device 714 may include housing 735 mounted on a top surface 737 of the downlight device 700. The selectable control device 714 may include a plurality of buttons 722, 724, 726, 728, 230, 732, and 734, which are similar to buttons 622-634 of FIG. 6. Alternatively, or additionally, the selectable control device 714 may include one or more slides, knobs, dials, or other suitable control mechanism. The selectable control device 714 in this example is user adjustable, in that it can be adjusted manually (i.e., by a person).

In embodiments, the selectable control device 714 can include a slider, and the positional movement of the slider is linear. In embodiments, the selectable control device 714 can include a rotatable knob and the positional movement of the knob is rotational. The knob might project from the enclosure 735 and be moved rotationally (i.e., turned) by the user's fingers along a range of angular positions (angular positional range) from a first end of an angular positional full-scale range (e.g., fully counterclockwise) to a second end of the angular positional full-scale range (e.g., fully clockwise), and vice versa. These embodiments may also include the buttons as depicted in FIG. 7

The indoor downlight device 700 further includes an LED driver 702. Driver 702 may be similar to one of the drivers 102, 202, 302, 402, and/or 502, previously described. The driver 702 includes AC/DC converters, voltage convertors, rectifiers, and/or other components to produce a low-voltage signal for powering light-emitting devices 732, 733, 734, and 735. In embodiments, light-emitting devices 732-735 are LED devices. In embodiments, one or more of the devices 732-735 emits light of a different CCT value than the others. In some embodiments, device 732 and 733 emit light of a first CCT value, and device 734 and device 735 emit light of a second CCT value. The light-emitting devices 732-735 are in positions relative to each other such that the first white light of the first CCT value will mix with the second white light of the second CCT value to yield a combined white light that has a combined CCT with a combined brightness. While four light-emitting devices are shown in FIG. 7, embodiments may have more or fewer light-emitting devices.

FIG. 8 is a perspective view of the indoor downlight device 700 of FIG. 7. In this view, the controls of the selectable control device 714 can be seen on the top surface 737. In such embodiments, the selectable control device 714 may be set to a desired setting prior to installation in a ceiling of a room. In addition to being included in an indoor downlight device, embodiments may also be included in lamps having a lightbulb form factor.

FIG. 9 is a side view of an embodiment utilizing a BR-type lightbulb 900. In this embodiment, the lightbulb may include multiple LEDs housed within enclosure 901. A selectable control device 914 may be disposed on the enclosure 901, near the base 949. The base 949 may include a screw terminal or other suitable connector to receive power. In this way, the lightbulb 900 can be configured for a desired CCT value and/or constant power/color temperature (CPCT) mode to be used with an external dimmer. Thus, in embodiments, the lightbulb comprises a BR-type form factor.

FIG. 10 is a side view of an embodiment utilizing an A-type lightbulb 1000. In this embodiment, the lightbulb may include multiple LEDs housed within enclosure 1001. A selectable control device 1014 may be disposed on the enclosure 1001, near the base 1049. The base 1049 may include a screw terminal or other suitable connector to receive power. In this way, the lightbulb 1000 can be configured for a desired CCT value and/or constant power/color temperature (CPCT) mode to be used with an external dimmer. Thus, in embodiments, the lightbulb comprises an A-type form factor.

FIG. 11 is a side view of an embodiment utilizing a PAR-type lightbulb 1100. In this embodiment, the lightbulb may include multiple LEDs housed within enclosure 1101. A selectable control device 1114 may be disposed on the enclosure 1101, near the base 1049. The base 1149 may include a screw terminal or other suitable connector to receive power. In this way, the lightbulb 1100 can be configured for a desired CCT value and/or constant power/color temperature (CPCT) mode to be used with an external dimmer. Thus, in embodiments, the lightbulb comprises a PAR-type form factor.

Figure 12:
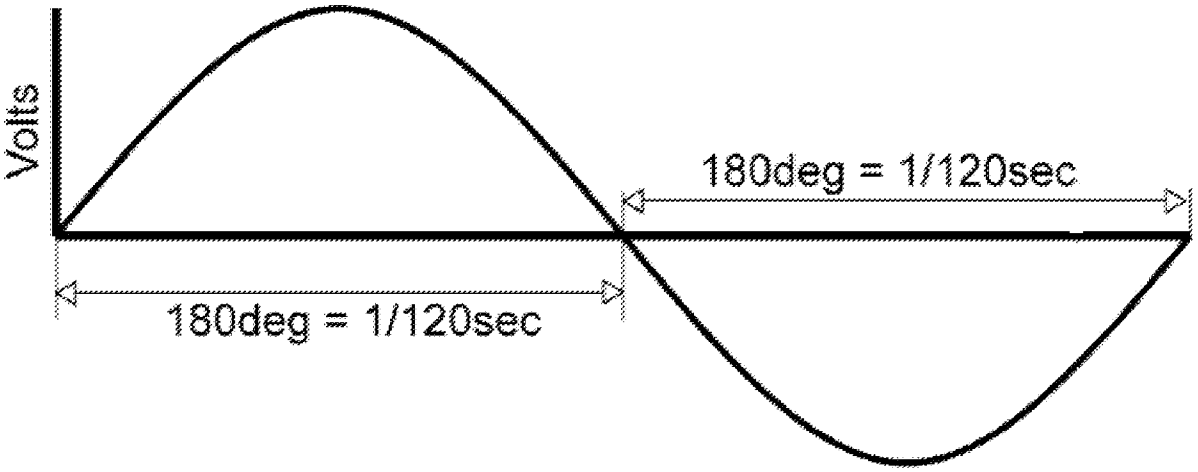

FIG. 12 shows a graph of voltage versus time of an example of a single cycle of mains supply power. The cycle corresponds to 360 degrees (deg) and lasts 1/60 second (sec). Accordingly, each half cycle of input voltage/current corresponds to 180 deg and has a duration of 1/120 sec.

Figure 13:
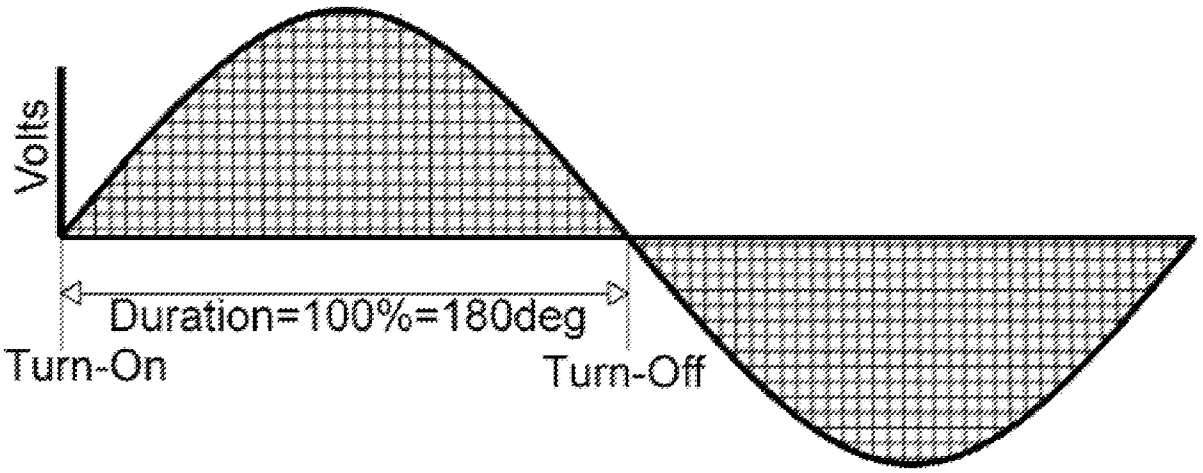
Figure 14:
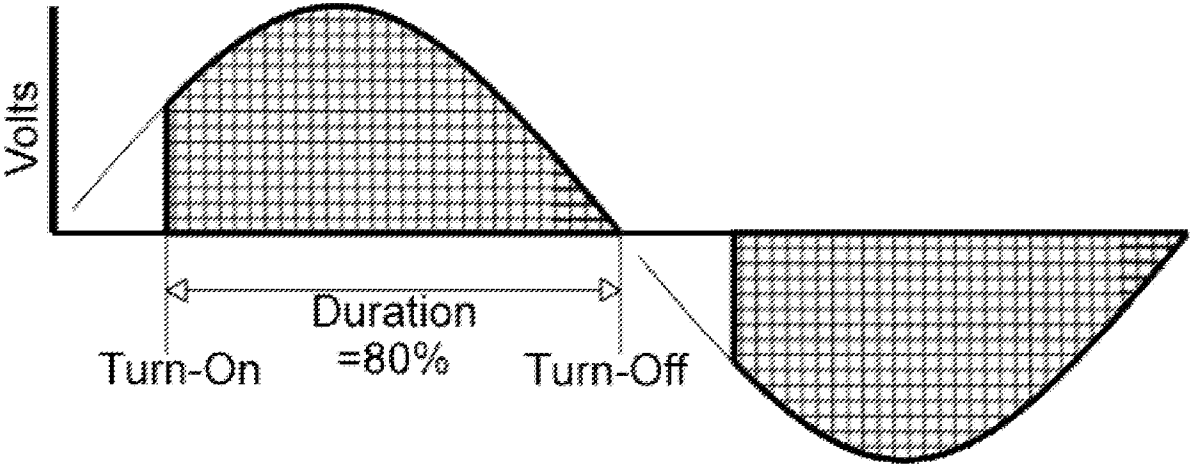
Figure 15:
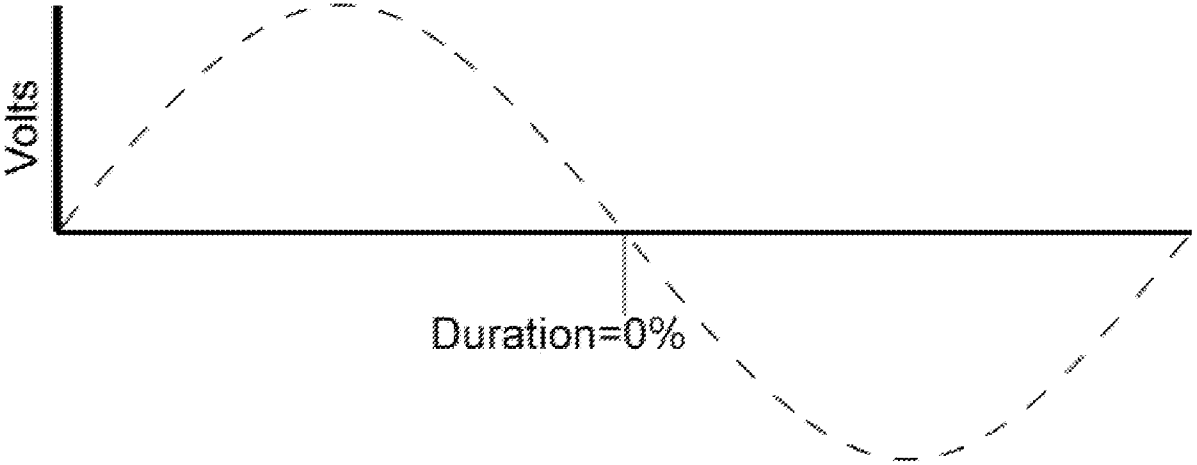

FIGS. 13-15 illustrate examples of different voltage traces of supply power that a dimmer is configured to output. The dimmer outputs only a segment of each half-cycle of the AC mains supply. Each output segment ends at, or substantially at, the end of the half-cycle (labelled "Turn-Off" in the figures) when the TRIAC turns off, which corresponds to 180 deg. Each output segment starts at a point in time (labelled "Turn-On" in the figures) when the TRIAC turns on. The Turn-On point is located at a point within the half-cycle, correlating to a cycle-angle between 0 deg and 180 deg, that is selected (controlled) by the user through the dimmer.

FIG. 13 shows an example in which a dimmer is at the first end of the operational full-scale range. This causes the TRIAC's Turn-On point, and thus the output segment's starting point, to be about 0 deg. So, the output segment's duration is about 180 deg, which corresponds to 100% of the half-cycle and about 1/120 sec.

FIG. 14 shows an example in which the dimmer is at an intermediate position about 80% of the way from the second end of the full-scale range to the first end of the full-scale range. This causes the TRIAC's Turn-On point to be about 20% of the way through the 180 deg half-cycle. So, the TRIAC is on for a duration of only 80% of the 180 deg half-cycle, corresponding to 1/150 sec (which is 80% of the 1/120 sec half-cycle).

FIG. 15 shows an example in which the dimmer is at the second end of the full-scale range. This causes the TRIAC's Turn-On point to be at the end of the half-cycle which coincides with the Turn-Off point, so that the output segment's duration is about 0 deg and about 0 sec.

As shown in FIGS. 13-15, the output segment's duration (in terms of time in seconds or cycle-angle in degrees) is a function of the user-interface component's value. And the user-interface component's value corresponds to the component's position or number-of-bars-lit or displayed number. As the user-interface component's position progresses from the first end, through the full-scale range, to the second end, the output supply's segment duration progresses from 180 deg down to 0 deg and from 1/120 sec down to 0 sec. Conversely, as the user-interface component's position progresses from the second end, through the full-scale range, to the first end, the dimmer's supply's segment duration progresses from 0 deg up to 180 deg and from 0 sec up to 1/120 sec. In this example, the segment duration is continuously-variable, and the position of the dimmer is continuously-variable, for the segment duration to be a smoothly-continuous monotonic function of the dimmer configuration.

FIG. 16 shows a schematic representation 1600 of a selectable control device 1610 in accordance with disclosed embodiments. Selectable control device 1610 includes variable resistance selection device 1620. In embodiments, variable resistance selection device 1620 can be a potentiometer, slider, rotary selection switch, and/or other suitable device. The selectable control device 1610 is coupled to a first bank of LEDs 1630 and a second bank of LEDs 1640 via a plurality of resistors, diodes, and/or other passive and/or active components. In embodiments, the first bank of LEDs 1630 has a first CCT value and the second bank of LEDs 1640 has a second CCT value. In embodiments, the first CCT value is 2700K and the second CCT value is 5000K. Other CCT values are possible in disclosed embodiments. Light from the first bank of LEDs 1630 and the second bank of LEDs 1640 can combine to create a combined light with a combined-light CCT value.

As can now be appreciated, disclosed embodiments enable color temperature and dimming functions on a dimming light of an existing lamp. This allows a user to easily obtain the color temperature and dimming brightness lighting experience. At the same time, due to the traditional TRIAC dimming interface, it can be compatible with the current dimmers on the market to the greatest extent, allowing for flexibility of use and ease of marketing.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. An apparatus comprising:

a housing;

an LED (light emitting diode) driver disposed within the housing, the driver configured to provide power to:

a first LED that is configured to emit a first white light of a first correlated color temperature (CCT);

a second LED that is configured to emit a second white light of a second CCT that is lower than the first CCT, for the first white light to mix with the second white light to yield a combined white light having a combined-light CCT with a combined-light brightness;

receive a user-adjustable DC input voltage Vin from a selectable control device, wherein the selectable control device is disposed near a bottom surface of the housing, and wherein the selectable control device comprises a plurality of CCT selection values; and distribute supply power to the first LED and second LED; and wherein the apparatus further comprises a base configured and disposed to mechanically and electrically engage with a light socket, wherein the base includes an Edison screw, and wherein the selectable control device is disposed on the enclosure near the base.

2. The apparatus of claim 1, wherein the selectable control device includes five CCT settings.

3. The apparatus of claim 2, wherein the five CCT settings include:

a 2700K setting;

a 3000K setting;

a 3500K setting;

a 4000K setting; and a 5000K setting.

4. The apparatus of claim 1, wherein the selectable control device includes a constant power color temperature (CPCT) setting.

5. The apparatus of claim 1, wherein the selectable control device is integrated into the LED driver.

6. The apparatus of claim 1, wherein the selectable control device is configured and disposed to be in series with the first LED and second LED.

7. An apparatus comprising:

a housing;

a microcontroller disposed within the housing;

an LED (light emitting diode) driver disposed within the housing;

a controller disposed within the housing, and configured to provide power to:

a first LED that is configured to emit a first white light of a first correlated color temperature (CCT);

a second LED that is configured to emit a second white light of a second CCT that is lower than the first CCT, for the first white light to mix with the second white light to yield a combined white light having a combined-light CCT with a combined-light brightness;

wherein the microcontroller is configured to receive a user-adjustable DC input voltage Vin from a selectable control device, wherein the selectable control device is disposed near a bottom surface of the housing, and wherein the selectable control device comprises a plurality of CCT selection values; and wherein the driver is configured to distribute supply power to the first and second light-emitting devices according to a power-distribution scheme based on a configuration of the selectable control device; and wherein the apparatus further comprises a base configured and disposed to mechanically and electrically engage with a light socket, wherein the base includes an Edison screw, and wherein the selectable control device is disposed on the enclosure near the base.

8. The apparatus of claim 7, wherein the selectable control device includes five CCT settings.

9. The apparatus of claim 7, wherein the five CCT settings include:

a 2700K setting;

a 3000K setting;

a 3500K setting;

a 4000K setting; and a 5000K setting.

10. The apparatus of claim 7, wherein the selectable control device includes a constant power color temperature (CPCT) setting.

11. The apparatus of claim 7, wherein the housing comprises a cylindrical upper section and a frustoconical lower section.

12. The apparatus of claim 7, wherein the selectable control device is integrated into the LED driver.

13. The apparatus of claim 7, wherein the microcontroller is configured such that the signal provided to the driver comprises a pulse-width modulated (PWM) signal.

14. A lightbulb comprising:

an enclosure;

a first LED (light emitting diode) disposed within the enclosure;

a second LED disposed within the enclosure;

an LED driver, the driver configured to:

provide power to:

the first LED, wherein the first LED is configured to emit a first white light of a first correlated color temperature (CCT); and the second LED, wherein the second LED is configured to emit a second white light of a second CCT that is lower than the first CCT, enabling the first white light to mix with the second white light to yield a combined white light having a combined-light CCT with a combined-light brightness;

receive a user-adjustable DC input voltage Vin from a selectable control device, wherein the selectable control device comprises a plurality of buttons corresponding to a plurality of CCT selection values; and distribute supply power to the first and second light-emitting devices according to a power-distribution scheme based on a configuration of the selectable control device; and a base configured and disposed to mechanically and electrically engage with a light socket, wherein the base includes an Edison screw, and wherein the selectable control device is disposed on the enclosure near the base.

15. The lightbulb of claim 14, wherein the selectable control device includes five CCT settings.

16. The lightbulb of claim 15, wherein the five CCT settings include:

a 2700K setting;

a 3000K setting;

a 3500K setting;

a 4000K setting; and a 5000K setting.

17. The lightbulb of claim 14, wherein the selectable control device includes a constant power color temperature (CPCT) setting.

18. The lightbulb of claim 14, wherein the lightbulb comprises an A-type form factor.

19. The lightbulb of claim 14, wherein the lightbulb comprises a PAR-type form factor.

20. The lightbulb of claim 14, wherein the lightbulb comprises a BR-type form factor.

* * * * *